US008139984B2

(12) United States Patent
Murakami et al.

(10) Patent No.: US 8,139,984 B2
(45) Date of Patent: Mar. 20, 2012

(54) IMAGE FORMING METHOD AND APPARATUS

(75) Inventors: Hiroyuki Murakami, Toyonaka (JP); Masahide Inoue, Numazu (JP); Chiyoshi Nozaki, Otsu (JP); Tsuyoshi Nozaki, Ikeda (JP); Atsushi Yamamoto, Kawanishi (JP); Takuya Kadota, Kobe (JP); Mitsuyo Matsumoto, Ibaraki (JP); Katsunori Kurose, Takarazuka (JP); Yoshimichi Ishikawa, Itami (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/911,928

(22) Filed: Oct. 26, 2010

(65) Prior Publication Data

US 2011/0045401 A1 Feb. 24, 2011

Related U.S. Application Data

(62) Division of application No. 11/851,617, filed on Sep. 7, 2007, now Pat. No. 7,867,685.

(30) Foreign Application Priority Data

Sep. 7, 2006 (JP) ..... 2006-243210

(51) Int. Cl.
*G03G 15/00* (2006.01)

(52) U.S. Cl. ..... 399/252; 399/174; 399/175; 399/176

(58) Field of Classification Search ..... 399/252, 399/174, 175, 176
See application file for complete search history.

(56) References Cited

U.S. PATENT DOCUMENTS

| | | | |
|---|---|---|---|
| 5,089,851 | A | 2/1992 | Tanaka et al. |
| 5,357,322 | A | 10/1994 | Hoshika |
| 5,443,873 | A | 8/1995 | Itani et al. |
| 5,486,906 | A | 1/1996 | Tsuneeda et al. |
| 5,532,097 | A | 7/1996 | Tavernier et al. |
| 5,557,374 | A | 9/1996 | Chen |
| 5,622,803 | A | 4/1997 | Tavernier et al. |
| 6,253,052 | B1 | 6/2001 | Cornelius et al. |
| 2006/0204882 | A1 | 9/2006 | Nozaki et al. |
| 2006/0210902 | A1 | 9/2006 | Nakamura et al. |
| 2006/0275686 | A1 | 12/2006 | Kadota et al. |
| 2006/0292474 | A1 | 12/2006 | Mikuriya et al. |
| 2007/0026335 | A1 | 2/2007 | Yamamoto et al. |
| 2007/0059625 | A1 | 3/2007 | Yamamoto et al. |
| 2007/0122729 | A1 | 5/2007 | Katoh et al. |
| 2007/0166635 | A1 | 7/2007 | Yamamoto et al. |
| 2007/0190442 | A1 | 8/2007 | Nakamura et al. |
| 2007/0190443 | A1 | 8/2007 | Hagi et al. |

FOREIGN PATENT DOCUMENTS

| | | |
|---|---|---|
| JP | 63030861 | 2/1988 |
| JP | 2-120865 | 5/1990 |
| JP | 03131867 A | 6/1991 |
| JP | 8-101526 | 4/1996 |
| JP | 10-307454 | 11/1998 |
| JP | 2000-81771 | 3/2000 |
| JP | 2001-34016 | 2/2001 |
| JP | 2001-242686 | 9/2001 |
| JP | 2003-131416 | 5/2003 |
| JP | 2003-207925 | 7/2003 |
| JP | 2006-258901 | 9/2006 |
| WO | WO 9744713 A1 | 11/1997 |

OTHER PUBLICATIONS

Owen, David. New York: Simon and Schuster Paperbacks. (2004) pp. 166-175.

*Primary Examiner* — Christopher Rodee
(74) *Attorney, Agent, or Firm* — Oblon, Spivak, McClelland, Maier & Neustadt, L.L.P.

(57) ABSTRACT

An image forming apparatus, wherein a surface resistivity Rse[Ω] of a charger and a volume resistivity Rsw [Ω·cm] of the composition having a low softening point satisfy the following relationship:

$$0.8\times10^{-1}Rse<Rvw<1.5\times10Rse$$

is provided. The image forming apparatus contains a photoreceptor; a charger configured to charge the photoreceptor with a charger contacting thereto; an irradiator configured to irradiate the photoreceptor to form an electrostatic latent image thereon; an image developer configured to develop the electrostatic latent image with a toner to form a toner image on the photoreceptor; a transferer configured to transfer the toner image onto a recording material directly or through an intermediate transferer; and a fixer configured to fix the toner image on the recording material, wherein the toner comprises: a binder resin; a colorant; a composition having a low softening point; and an external additive.

13 Claims, 1 Drawing Sheet

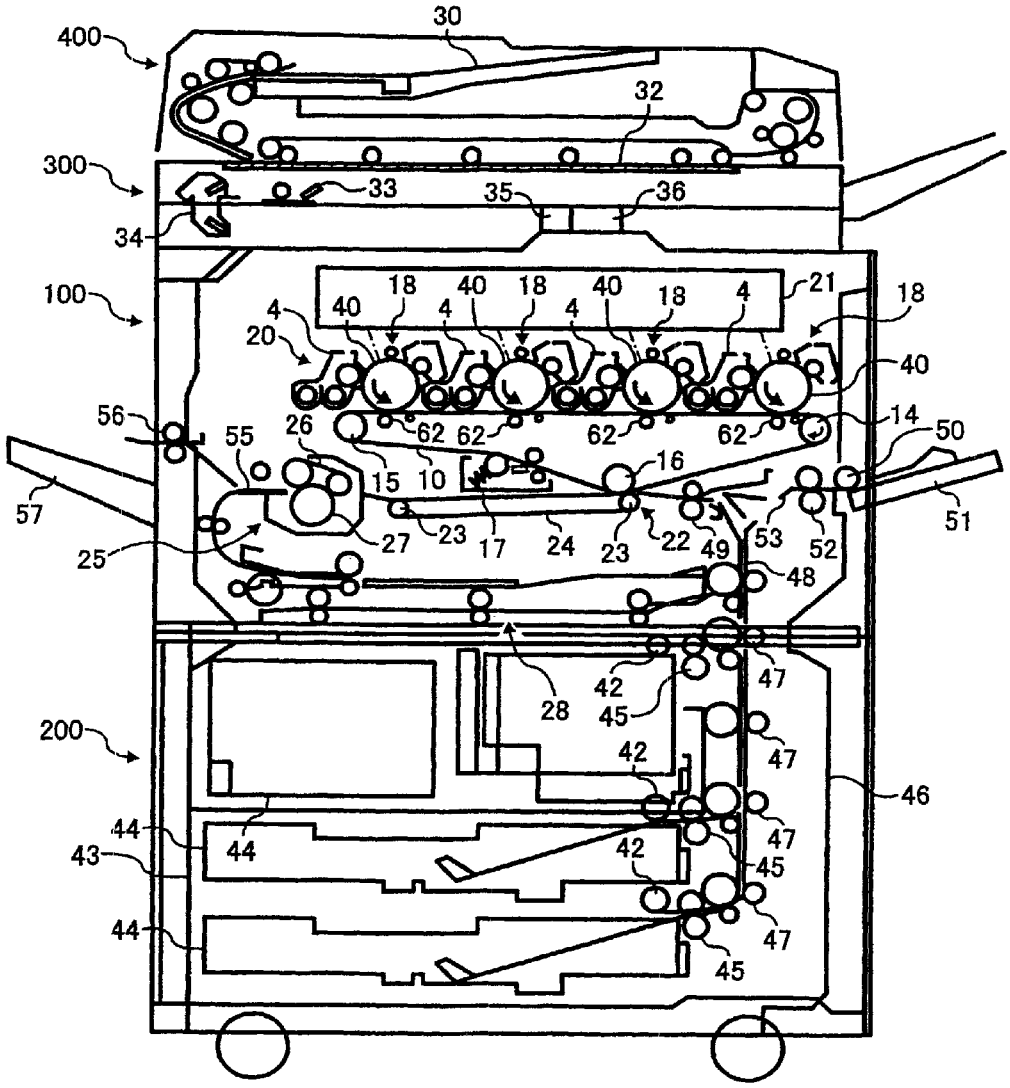
400
30
32
300
33
35
36
34
100
18
40
18
40
18
40
18
4
4
4
4
21
18
20
40
56
26
62
62
62
62
14
50
55
15
10
16
57
27
23
17
24
23
22
49
53
52
51
25
48
28
42
45
47
200
42
47
46
44
44
43
42
47
45
44
47
45

IMAGE FORMING METHOD AND APPARATUS

CROSS REFERENCE TO RELATED APPLICATIONS

This application is a divisional application of prior U.S. patent application Ser. No. 11/851,617, filed Sep. 7, 2007, now U.S. Pat. No. 7,867,685 the disclosure of which is incorporated herein by reference in its entirety. The parent application claims priority to Japanese Application No. 2006-243210, filed Sep. 7, 2006, the disclosure of which is incorporated herein by reference in its entirety.

BACKGROUND OF THE INVENTION

1. Field of the Invention

The present invention relates to an image forming method, and more particularly to an image forming method using a contact charging method wherein a charger charges a photoreceptor while contacting thereto.

2. Discussion of the Background

Conventionally, a corona charging method has been used for charging a photoreceptor so as to have a predetermined potential. The corona charging method includes a discharge electrode such as a wire electrode and a shield electrode surrounding the discharge electrode. A high voltage is applied to the discharge electrode and shield electrode to cause a corona shower charging the surface of the photoreceptor.

Recently, a contact charging method which is more environmental resistant and power saving than the corona charging method is put into practical use. The contact charging method contacts a charger to a photoreceptor and a predetermined bias is applied to the charger to charge surface of the photoreceptor. The contact charging method includes many methods using a roller, a fur brush, etc. for charging the photoreceptor.

Namely, the contact charging method uses a charge injector injecting a charge into the photoreceptor from the charger without a discharge phenomenon.

Specifically, the charge injector injects a charge from the charger into a charge holder such as a trap level or an electroconductive particulate material on the surface of the photoreceptor. The charge injector does not need a discharge, and a potential of the charged photoreceptor is proportional to a charging bias. Namely, even when a voltage applied to the contact charger is not greater than a discharge threshold, the photoreceptor can be charged to have a potential equivalent to the voltage. Further, the charge injector does not have an adverse effect such as image distortion due to a discharge product because of needing no discharge.

The charge injector needs to improve the contact between the charger and photoreceptor (firmly contact the charge to the surface of the photoreceptor) to improve the charge injection efficiency (uniformly charge the photoreceptor). However, the conventionally-used charger using a roller or a fur brush is difficult to firmly contact the surface of the photoreceptor due to reforming accuracy and wearing of the surface of the photoreceptor.

Contacting plural points of the charger to the photoreceptor is considered to improve the contact therebetween. Specifically, the traveling speed of the photoreceptor is differentiated from that of the charger at the contact point. However, it is difficult to contact a roller to the photoreceptor due to a friction therebetween. Although it is easier to contact a fur brush to the photoreceptor with a speed difference, the fur brush does not fully contact the photoreceptor.

Japanese Published Unexamined Patent Application No. 10-307454 discloses placing an electroconductive particulate material between a photoreceptor and a contact charger for the purpose of improving electrical contact therebetween, particularly facilitating the speed differentiation between a roller charger and a photoreceptor.

Japanese Published Unexamined Patent Application No. 10-307454 discloses a method of directly providing the electroconductive particulate material to a charger; Japanese Published Unexamined Patent Application No. 2000-81771 discloses a method of providing the electroconductive particulate material from an image developer; and Japanese Published Unexamined Patent Application No. 2001-242686 discloses a method of providing the electroconductive particulate material from a transferer.

Many methods of adding the electroconductive particulate material as an external additive are also disclosed. For example, it is widely known that a carbon black is added to the surface of a toner to impart conductivity thereto and control electrical properties thereof. Japanese Published Unexamined Patent Application No. 2-120865 discloses a method of adding an electroconductive particulate material comprising polyaniline.

The electroconductive particulate material adheres to or mixes in a contact charger and is placed at a contact point between a photoreceptor and the contact charger. The electroconductive particulate material fills a gap between the contact charger and the photoreceptor to improve the electrical contact therebetween even when the surfaces thereof are nonuniform. Further, the electroconductive particulate material works as a spacer to facilitate contacting the charger to the photoreceptor with a speed difference. Thus, since the electroconductive particulate material can maintain contact of the charger to the photoreceptor, the contact charger can well inject a charge into the photoreceptor.

However, even when a combination of the contact charger and electroconductive particulate material is used, defective images due to defective charge are produced because it is difficult to control adherence of the electroconductive particulate material to a photoreceptor and environmental resistance thereof.

Recently, an oilless fixer has been put into practice in terms of writability of recoding papers. A toner including a wax is typically used for the oilless fixer. Japanese Published Unexamined Patent Application No. 2001-34016 discloses a wet-type polymerized toner, which mostly includes a wax having a large particle diameter in the center thereof because the wax is difficult to minutely disperse therein. Therefore, the wax is difficult to exude on the surface of the toner from the center thereof even when a heat and a pressure is applied thereto, resulting in insufficient hot offset (to a fixing roller) resistance thereof.

Japanese Published Unexamined Patent Application No. 8-101526 discloses a toner, on the surface of which a wax is much exposed, effectively preventing the hot offset in the fixing process. However, a wax typically having a low softening point and hardness adheres to every part of an image forming apparatus, resulting in production of defective images.

Japanese Published Unexamined Patent Applications Nos. 2003-131416 and 2003-207925 disclose a toner on which a wax is present, which possibly has the same problem as the above-mentioned toner disclosed in Japanese Published Unexamined Patent Application No. 8-101526.

Particularly, in order to fully charge a one-component developer which is a toner, the layer thickness of the toner on a developing roller needs to be thin. This is because only the surface of the toner layer is charged, i.e., the toner layer is not uniformly charged when thick. An excessive mechanical stress applied to the toner layer accelerates exposure of the wax on the surface of the toner and causes adherence thereof to every part of an image forming apparatus such as a contact charger, resulting in defective images such as stripe images.

Even when the adherence is prevented such that stripe images are not produced, a typical wax has a resistivity (insulativity) higher than that of the contact charger, resulting in production of defective images due to defective charge.

Because of these reasons, a need exists for an image forming method which uses a toner including a wax, preventing adherence of the wax to every part of an image forming apparatus such as a contact charger, and production of defective images due to defective charge even when the wax adheres thereto.

SUMMARY OF THE INVENTION

Accordingly, an object of the present invention is to provide an image forming method which uses a toner including a wax, preventing adherence of the wax to every part of an image forming apparatus such as a contact charger, and production of defective images due to defective charge even when the wax adheres thereto.

Another object of the present invention is to provide a toner used for the image forming method.

A further object of the present invention is to provide an image forming apparatus using the image forming method.

Another object of the present invention is to provide a process cartridge using the image forming method.

These objects and other objects of the present invention, either individually or collectively, have been satisfied by the discovery of an image forming method, comprising:

charging a photoreceptor with a charger contacting thereto;

irradiating the photoreceptor to form an electrostatic latent image thereon;

developing the electrostatic latent image with a toner to form a toner image on the photoreceptor;

transferring the toner image onto a recording material directly or through an intermediate transferer; and fixing the toner image on the recording material, wherein the toner comprises:

a binder resin;

a colorant;

a composition having a low softening point; and an external additive, and wherein a surface resistivity Rse[Ω] of the charger and a volume resistivity Rsw [Ω·cm] of the composition having a low softening point satisfy the following relationship:

$$0.8\times10^{-1}Rse<Rvw<1.5\times10Rse.$$

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

The FIGURE is a schematic cross-sectional view illustrating an embodiment of the image forming apparatus of the present invention.

DETAILED DESCRIPTION OF THE INVENTION

The present invention provides an image forming method which uses a toner including a wax, preventing adherence of the wax to every part of an image forming apparatus such as a contact charger, and production of defective images due to defective charge even when the wax adheres thereto.

More particularly, the present invention provides an image forming method, comprising:

charging a photoreceptor with a charger contacting thereto;

irradiating the photoreceptor to form an electrostatic latent image thereon;

developing the electrostatic latent image with a toner to form a toner image on the photoreceptor;

transferring the toner image onto a recording material directly or through an intermediate transferer; and fixing the toner image on the recording material, wherein the toner comprises:

a binder resin;

a colorant;

a composition having a low softening point; and an external additive, and wherein a surface resistivity Rse[Ω] of the charger and a volume resistivity Rsw [Ω·cm] of the composition having a low softening point satisfy the following relationship.

$$0.8\times10^{-1}Rse<Rvw<1.5\times10Rse.$$

FIG. is a schematic view illustrating an embodiment of a tandem-type electrophotographic image forming apparatus using an indirect transferer. Numeral 100 is a copier, 200 is a paper feeding table, 300 is a scanner on the copier 100 and 400 is an automatic document feeder (ADF) on the scanner 300. The copier 100 includes an intermediate transferer 10 having the shape of an endless belt.

The intermediate transferer 10 is suspended by three suspension rollers 14, 15 and 16 and rotatable in a clockwise direction. On the left of the suspension roller 15, an intermediate transferer cleaner 17 is located to remove a residual toner on an intermediate transferer 10 after an image is transferred.

Above the intermediate transferer 10, four image forming units 18 each including a charger, an image developer, a cleaner, etc. for yellow, cyan, magenta and black colors are located in line from left to right along a transport direction of the intermediate transferer 10 to form a tandem image forming apparatus 20.

Above the tandem image forming apparatus 20, an image developer 21 is located. On the opposite side of the tandem image forming apparatus 20 across the intermediate transferer 10, a second transferer 22 is located. The second transferer 22 includes a an endless second transfer belt 24 and two rollers 23 suspending the endless second transfer belt 24, and is pressed against the suspension roller 16 across the intermediate transferer 10 and transfers an image thereon onto a sheet.

Beside the second transferer 22, a fixer 25 fixing a transferred image on the sheet is located. The fixer 25 includes an endless belt 26 and a pressure roller 27 pressed against the belt.

The second transferer 22 also includes a function of transporting the sheet an image is transferred on to the fixer 25. As the second transferer 22, a transfer roller and a non-contact charger may be used. However, they are difficult have such a function of transporting the sheet.

In FIG., below the second transferer 22 and the fixer 25, a sheet reverser 28 reversing the sheet to form an image on both sides thereof is located in parallel with the tandem image forming apparatus 20.

Each of the image forming units 18 includes an image developer 4 using a developer including the toner of the present invention. The image developer 4 bears and transports the developer, and applies an alternate electric field to a photoreceptor 40 to develop a latent image thereon. The alternate electric field activates the developer and narrows the charge distribution of the toner to improve the developability of the developer.

A process cartridge includes at least the image developer 4 and the photoreceptor 40, and may include a charger or a cleaner, which is detachable from an image forming apparatus.

An original is set on a table 30 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the original.

When a start switch (not shown) is put on, a drive motor (not shown) rotates one of the suspension rollers 14, 15 and 16 such that the other two rollers are driven to rotate, to rotate the intermediate transferer 10. At the same time, each of the image forming units 18 rotates the photoreceptor 40 and forms a single-colored image, i.e., a black image, a yellow image, a magenta image and cyan image on each photoreceptor 40. The single-colored images are sequentially transferred onto the intermediate transferer 10 to form a full-color image thereon.

On the other hand, when start switch (not shown) is put on, one of paper feeding rollers 42 of paper feeding table 200 is selectively rotated to take a sheet out of one of multiple-stage paper cassettes 44 in a paper bank 43. A separation roller 45 separates sheets one by one and feed the sheet into a paper feeding route 46, and a feeding roller 47 feeds the sheet into a paper feeding route 48 of the copier 100 to be stopped against a resist roller 49.

Otherwise, a paper feeding roller 50 is rotated to take a sheet out of a manual feeding tray 51, and a separation roller 52 separates sheets one by one and feed the sheet into a paper feeding route 53 to be stopped against a resist roller 49.

Then, in timing with a synthesized full-color image on the intermediate transferer 10, the resist roller 49 is rotated to feed the sheet between the intermediate transferer 10 and the second transferer 22, and the second transferer transfers the full-color image onto the sheet.

The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Otherwise, the switch-over click 55 feeds the sheet into the sheet reverser 28 reversing the sheet to a transfer position again to form an image on the backside of the sheet, and then the sheet is discharged by the discharge roller 56 onto the catch tray 57.

On the other hand, the intermediate transferer 10 after transferring an image is cleaned by the intermediate transferer cleaner 17 to remove a residual toner thereon after the image is transferred, and ready for another image formation by the tandem image forming apparatus 20.

In the present invention, the charging method is a contact charging method.

The contact chargers include a roller charger, a fur brush charger, a magnetic brush charger, a blade charger, etc. Among these chargers, the roller charger or the fur brush charger is preferably used.

Hereinafter, the roller charger and the fur brush charger will be explained, but the present invention is not limited thereto.

The roller charger has the shape of a cylinder including a core metal, an electroconductive layer located overlying the core metal and a surface layer located overlying the electroconductive layer.

A voltage applied to the core metal from an electrical source is applied to a photoreceptor through the electroconductive layer and surface layer to charge the surface thereof.

The core metal is located along the MD (machine direction) or TD ((machine) traverse direction) of the photoreceptor, and alternatively in a longitudinal direction when the photoreceptor has the shape of a small-diameter cylinder or an endless belt. The charger is pressed against the photoreceptor at a predetermined pressure. Therefore, a part of the photoreceptor and a part of the charger contact each other in each other's longitudinal directions to form a contact nip having a predetermined width. The photoreceptor is rotated by a driver and the charger is driven to rotate in accordance with the rotation thereof.

The photoreceptor is charged through a neighborhood of the contact nip. The surface of the charger and that of the photoreceptor contacts each other in comparatively a wide area.

The electroconductive layer is nonmetallic and preferably formed of a material having low hardness, e.g., resins such as polyurethane, polyether and polyvinylalcohol; and rubbers such as hydrin, EPDM and NBR. The electroconductive materials include carbon black, graphite, titanium oxide, zinc oxide, etc.

The surface layer is formed of a material having a medium resistivity.

For examples, resins such as nylon, polyamide, polyimide, polyurethane, polyester, silicone, TEFLON (Brand name), polyacetylene, polypyrrole, polythiophene, polycarbonate and polyvinyl can be used. A fluorine-containing resin is preferably used to increase a contact angle with water.

Specific examples of the fluorine-containing resin include polyfluorovinylidene, polyfluoroethylene, vinylidenefluoride-tetrafluoroethylene copolymers, vinylidenefluoride-tetrafluoroethylene-hexafluoropropylene copolymers.

A electroconductive material such as carbon black, graphite, titanium oxide, zinc oxide, tin oxide and iron oxide may optionally be included such that the surface layer has a medium resistivity.

The fur brush charger includes an electroconductive core metal a voltage is applied to from a voltage applicator and brush fibers covering an outer circumference of the core metal. The brush fibers are woven in an electroconductive base cloth, and there is an electroconductive coating layer between the backside of the base cloth and the core metal. The surface of the photoreceptor is charged through the brush fibers.

Hereinafter, the brush is specifically explained, but is not limited thereto.

The brush fiber is a carbon-dispersed 6 nylon, and has a thickness not less than 3d and a density not less than 200,000 fibers/inch$^2$.

The brush rotates in the same direction of the photoreceptor, and is longer than a gap between the photoreceptor and the base cloth by 0.1 to 1.4 mm. The peripheral speed ratio thereof to that of the photoreceptor is from 1.5 to 4.

The surface resistivity Rse of the contact charger is measured with a resistivity meter MCP-HT450 from Dia Instruments Co., Ltd. in accordance with JIS K 6911 when applied with DC 1000 V. According to JIS K 6911, surface resistivity is defined as the quotient of the voltage gradient parallel to the current along the surface of the test piece divided by the current per unit width of the surface. This value equals the surface resistance between the two electrodes forming the opposite two sides of a square with 1 cm sides. The measurement environment is 23° C. and 45% RH. The surface resistivity is calculated by the following equation:

$$Rse = [\pi(D+d)/(D-d)] \times R_S$$

wherein

D is the inside diameter of the ring electrode on the face (cm), d is the outside diameter of the inner circle of the face electrode(cm), and $R_s$ is the surface resistance (MΩ).

The surface resistivity Rse is preferably from $1\times10^3$ to $1\times10^8$ [Ω], and more preferably from $1\times10^4$ to $1\times10^7$ [Ω]. When less than $1\times10^3$ [Ω], the charge is not fully injected into the photoreceptor. When higher than $1\times10^8$ [Ω], it is difficult to prevent the charge from leaking through a pin hole when present.

The toner of the present invention is prepared by dispersing and emulsifying toner constituents liquid wherein at least a polyester prepolymer having a functional group including a nitrogen atom, a polyester resin, a colorant and a wax are dispersed in an organic solvent in an aqueous medium in the shape of a droplet to be subjected to a crosslinking and/or an elongation reaction.

Next, the toner constituents and a method of preparing the toner are explained.

The polyester can be formed by a polycondensation reaction between a polyol compound and a polycarbonate compound.

As the polyol (PO), diol (DIO) and triol (TO) can be used, and the DIO alone or a mixture of the DIO and a small amount of the TO is preferably used. Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and promellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polycondensation reaction between the PO and PC is performed by heating the Po and PC at from 150 to 280° C. in the presence of a known esterification catalyst such as tetrabutoxytitanate and dibutyltinoxide and removing produced water while optionally depressurizing to prepare polyester having a hydroxyl group. The polyester preferably has a hydroxyl value not less than 5, and an acid value of from 1 to 30 and more preferably from 5 to 20. When the polyester has an acid value within the range, the resultant toner tends to be negatively charged to have good affinity with a recording paper and low-temperature fixability of the toner on the recording paper improves. However, when the acid value is greater than 30, the resultant toner is not stably charged and the stability becomes worse by environmental variations.

The polyester preferably has a weight-average molecular weight of from 10,000 to 400,000, and more preferably form 20,000 to 200,000. When the weight-average molecular weight is less than 10,000, offset resistance of the resultant toner deteriorates. When greater than 400,000, low-temperature fixability thereof deteriorates.

The polyester preferably includes a urea-modified polyester besides an unmodified polyester formed by the above-mentioned polycondensation reaction. The urea-modified polyester is formed by reacting a polyisocyanate compound (PIC) with a carboxyl group or a hydroxyl group at the end of the polyester formed by the above-mentioned polycondensation reaction to form a polyester prepolymer (A) having an isocyanate group, and reacting amine with the polyester prepolymer (A) to crosslink and/or elongate a molecular chain thereof.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α', α'-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

The content of the PIC in the polyester prepolymer (A) having a polyisocyanate group is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoronediamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan.

Specific examples of the amino acids (B5) include amino propionic acid and amino caproic acid. Specific examples of the blocked amines (B6) include ketimine compounds which are prepared by reacting one of the amines (B1) to (B5) mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

The urea-modified polyester may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester can be prepared by a method such as a one-shot method. The PO and PC are heated at from 150 to 280° C. in the presence of a known esterification catalyst such as tetrabutoxytitanate and dibutyltinoxide and removing produced water while optionally depressurizing to prepare polyester having a hydroxyl group. Next, the polyisocyanate is reacted with the polyester at from 40 to 140° C. to form a polyester prepolymer (A) having an isocyanate group. Further, the amines (B) are reacted with the (A) at from 0 to 140° C. to form a urea-modified polyester.

When the PIC, and (A) and (B) are reacted, a solvent may optionally be used. Specific examples of the solvents include inactive solvents with the PIC such as aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

The weight-average molecular weight of the urea-modified polyester is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

A combination of the urea-modified polyester and the unmodified polyester improves low temperature fixability of the resultant toner and glossiness of color images produced thereby, and is more preferably used than using the urea-modified polyester alone. Further, the unmodified polyester may include modified polyester except for the urea-modified polyester.

It is preferable that the urea-modified polyester at least partially mixes with the unmodified polyester to improve the low temperature fixability and hot offset resistance of the resultant toner. Therefore, the urea-modified polyester preferably has a structure similar to that of the unmodified polyester.

A mixing ratio between the unmodified polyester and urea-modified polyester is from 20/80 to 95/5, preferably from 70/30 to 95/5, more preferably from 75/25 to 95/5, and even more preferably from 80/20 to 93/7. When the urea-modified polyester is less than 5%, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45 to 65° C., and preferably from 45 to 60° C. When the glass transition temperature is less than 45° C., the high temperature preservability of the toner deteriorates. When higher than 65° C., the low temperature fixability deteriorates.

As the urea-modified polyester is liable to be present on a surface of the toner, the resultant toner has better heat resistance preservability than known polyester toners even though the glass transition temperature of the urea-modified polyester is low.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like These materials are used alone or in combination. The toner particles preferably include the colorant in an amount of from 1 to 15% by weight, and more preferably from 3 to 10% by weight.

The colorant for use in the present invention can be used as a masterbatch pigment when combined with a resin. Specific examples of the resin for use in the masterbatch pigment or for use in combination with masterbatch pigment include the modified and unmodified polyester resins mentioned above; styrene polymers and substituted styrene polymers such as polystyrene, poly-p-chlorostyrene and polyvinyltoluene; or their copolymers with vinyl compounds; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acrid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added and toner manufacturing method (such as dispersion method) used, and is not particularly limited.

However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

The wax preferably has a low melting point of from 60 to 100° C., and more preferably from 70 to 90° C., which effectively works between a fixing roller and a toner. The resultant toner has good hot offset resistance without application of wax such as an oil to the fixing roller.

The wax for use in the present invention is a hydrocarbon wax having good releasability from the fixing roller and a low polarity.

The hydrocarbon wax is formed of only a carbon atom and a hydrogen atom, and does not include an ester group, an alcohol group or an amide group. Specific examples the hydrocarbon wax include polyolefin waxes such as polyethylene, polypropylene and an ethylene-propylene copolymer; petroleum waxes such as a paraffin wax and a microcrystalline wax; and synthetic waxes such as a Fischer-Tropsh wax. In the present invention, the polyethylene wax, paraffin wax and Fischer-Tropsh wax are preferably used, and the polyethylene wax and paraffin wax are more preferably used.

The wax can be melted and kneaded with a masterbatch or a binder resin as the charge controlling agent can, and may be added to an organic solvent when the masterbatch or binder resin are dissolved and dispersed therein.

The volume resistivity Rsw [Ω·cm] of the composition having a low softening point is measured with a resistivity meter R8340 from ADVANTEST CORP. in accordance with JIS K 6911 when applied with DC 1000 V. The measurement environment is 23° C. and 45% RH.

The volume resistivity of the hydrocarbon wax is from $1\times10^{13}$ to $1\times10^{15}$ [Ω·cm].

This is considerably higher than the surface resistivity Rse of the contact charger ($1\times10^{3}$ to $1\times10^{8}$ [Ω]), and the wax tends to adhere to the charger, resulting in defective charge.

In the present invention, the volume resistivity of the wax is controlled.

The wax preferably has a lower resistivity, including an ionic surfactant and/or an electroconductive particulate material. The wax preferably includes the ionic surfactant and/or the electroconductive particulate material in an amount of from 0.05 to 5 parts by weight, and more preferably from 0.25 to 3 parts by weight. Namely, only a small amount thereof is sufficient and not than necessary.

Specific examples of the ionic surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

Specific examples of the electroconductive particulate material include a carbon fine powder such as carbon black, a metallic fine powder such as aluminum, a metal oxide such as titanium oxide, a metallic compound such as kalium titanate, or their complex oxides.

The toner of the present invention preferably includes a wax in an amount of 2 to 6% by weight, more preferably from 3 to 6% by weight, and furthermore preferably from 3 to 5% by weight. When less than 2% by weight, the wax does not sufficiently exude between the melted toner and a fixer and the adherence therebetween does not decrease, resulting in nonseparation of a recoding material from the fixer. When greater than 6% by weight, the wax exposed on the surface of the toner increases, resulting in deterioration of the fluidity of the toner. Therefore, the transferability of the toner from an image developer to a photoreceptor and therefrom to a recording material deteriorates, resulting in noticeable deterioration of image quality. Further, the wax leaves from the toner, resulting in contamination of the image developer and photoreceptor.

A method of measuring wax quantity on the surface of a toner (ATR method) is explained.

A toner is pressed at 6 tons for 1 min to be disk-shaped. The surface of the disk-shaped toner is measured by ATR method (using Ge crystal) with FT-IR from PerkinElmer, Inc.

A relative ratio P between a peak specific to the wax (2,850 $cm^{-1}$) and a peak specific to the resin (828 $cm^{-1}$) is defined as a surface wax quantity, which is present within the depth of 0.3 μm from the surface of the toner.

In the present invention, the surface wax quantity, i.e., the relative ratio P is from 0.02 to 0.2.

External additives for use in the present invention are preferably at least two or more inorganic particulate materials selected from the group consisting of silica, titanium oxide, alumina, zinc oxide, tin oxide and forsterite. Plural kinds of the same inorganic particulate material may be used.

Other inorganic particulate materials such as quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide and silicon nitride may be used together.

A method of preparing the toner of the present invention is explained, but is not limited thereto.

(1) Dispersing a colorant, an unmodified polyester, a polyester prepolymer having an isocyanate group and a wax in an organic solvent to prepare a toner constituents liquid.

The organic solvent is preferably volatile, having a boiling point less than 100° C. because of being easily removed after parent toner particles are formed. Specific examples of the organic solvent include toluene, xylene, benzene, carbon tetrachloride, methylenechloride, 1,2-dichloroethane, 1,1,2-trichloroethane, trichloroethylene, chloroform, monochlorobenzene, dichloroethylidene, methylacetate, ethylacetate, methyl ethyl ketone, methylisobutylketone, etc. These can be used alone or in combination. Particularly, aromatic solvents such as toluene and xylene and halogenated hydrocarbons such as methylenechloride, 1,2-dichloroethane, chloroform and carbon tetrachloride are preferably used. The toner constituents liquid preferably includes an organic solvent in an amount of from 0 to 300 parts by weight, more preferably from 0 to 100 parts by weight, and furthermore preferably from 25 to 70 parts by weight per 100 parts by weight of the prepolymer.

(2) Emulsifying the toner constituents liquid in an aqueous medium under the presence of a surfactant and a particulate resin.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner constituents liquid preferably includes the aqueous medium is typically from 50 to 2,000 parts by weight, and preferably from 100 to 1,000 parts by weight. When less than 50 parts by weight, the toner constituents liquid is not well dispersed and toner particles having a predetermined particle diameter cannot be formed. When greater than 2,000 parts by weight, the production cost increases.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

The particulate resin is included to stabilize a parent toner particles formed in the aqueous medium. Therefore, the particulate resin is preferably included so as to have a coverage of from 10 to 90% over a surface of the toner particle. Specific examples of the particulate resins include particulate polymethylmethacrylate having a particle diameter of 1 μm and 3 μm, particulate polystyrene having a particle diameter of 0.5 μm and 2 μm and a particulate polystyrene-acrylonitrile having a particle diameter of 1 μm. These are marketed as PB-200 from Kao Corporation, SGP from Soken Chemical & Engineering Co., Ltd., Technopolymer SB from Sekisui Plastics Co., Ltd., SGP-3G from Soken Chemical & Engineering Co., Ltd. and Micro Pearl from Sekisui Chemical Co., Ltd.

In addition, inorganic dispersants such as tricalcium phosphate, calcium carbonate, titanium oxide, colloidal silica and hydroxy apatite can also be used.

As dispersants which can be used in combination with the above-mentioned particulate resin and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or a elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a parent toner particle.

The prepared emulsified dispersion (reactant) is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

5) A charge controlling agent is beat in the parent toner particle, and inorganic particulate materials such as particulate silica and particulate titanium oxide are externally added thereto to form a toner.

Known methods using a mixer, etc. are used to beat in the charge controlling agent and to externally add the inorganic particulate materials.

Thus, a toner having a small particle diameter and a sharp particle diameter distribution can be obtained. Further, the strong agitation in the process of removing the organic solvent can control the shape of a toner from a sphere to a rugby ball, and the surface morphology thereof from being smooth to a pickled plum.

The toner of the present invention preferably has a volume-average particle diameter of from 3 to 10 μm. The smaller the particle diameter, the higher the reproducibility of thin lines, and high-quality images can be produced. A droplet having a diameter less than 3 μm is difficult to form in an aqueous medium. When greater than 10 μm, a dry pulverized toner can be prepared at lower cost. In addition, the toner of the present invention preferably has a ratio (Dv/Dn) of the volume-average particle diameter (Dv) to a number-average particle diameter (Dn) of the toner of from 1.05 to 1.40. A sharp particle diameter distribution means a uniform charge quantity distribution of the toner producing high-quality images with less background fouling and having high transferability. A toner having the ratio less than 1.05 is difficult to prepare. When greater than 1.40, the charge quantity distribution is wide and high-quality images are difficult to produce.

The toner of the present invention can have high sphericity. A projected image of the toner preferably has an average circularity SR not less than 0.93. SR=(peripheral length of a circle having an area equivalent to a projected area of the toner/peripheral length of a projected image of the toner)× 100 [%]. The closer to true sphericity, the closer to 100%.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

<Synthesis of Polyester>

235 parts of an adduct of bisphenol A with 2 moles of ethyleneoxide and 525 parts of an adduct of bisphenol A with 3 moles of propyleneoxide, 205 parts terephthalic acid, 47 parts of an adipic acid and 2 parts of dibutyltinoxide were reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 46 parts of a trimellitic acid anhydride were added therein and the mixture was reacted for 2 hrs at normal pressure and 180° C. to prepare polyester 1. The polyester 1 had a number-average molecular weight of 2,600, a weight-average molecular weight of 6,900, a Tg of 44° C. and an acid value of 26.

<Synthesis of Prepolymer>

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized to 10 to 15 mm Hg and reacted for 5 hrs to prepare an intermediate polyester 1. The intermediate polyester 1 had a number-average molecular weight of 2,100, a weight-average molecular weight of 9,500, a Tg of 55° C. and an acid value of 0.5 and a hydroxyl value of 49.

Next, 411 parts of the intermediate polyester 1, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer 1. The prepolymer 1 included a free isocyanate in an amount of 1.53% by weight.

<Preparation of Masterbatch)

40 parts of carbon black REGAL 400R from Cabot Corp., 60 parts of a binder resin, i.e., a polyester resin RS-801 having an acid value of 10, a Mw of 20,000 and a Tg of 64° C. and 30 parts of water were mixed by a HENSCHEL mixer to prepare a water-logged pigment agglomerate. This was kneaded by a two-roll mil having a surface temperature of 130° C. for 45 min, extended upon application of pressure, cooled and pulverized by a pulverizer to prepare a masterbatch 1 having a particle diameter of 1 mm.

<Preparation of Pigment and Wax Dispersion Liquid (Oil Phase)>

545 parts of the polyester 1, 82.8 parts of paraffin wax including an alkyl acid phosphate in an amount of 1% by weight and 850 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 400 parts of the masterbatch 1 and 80 parts of ethyl acetate were added to the mixture and mixed for 1 hr to prepare a material solution 1.

1,000 parts of the material solution 1 were transferred into another vessel, and the carbon black and wax therein were dispersed by a beads mill (Ultra Visco Mill from IMECS CO., LTD.) for 3 passes under the following conditions:

liquid feeding speed of 1 kg/hr peripheral disc speed of 6 m/sec, and filling zirconia beads having a diameter of 0.5 mm for 80% by volume.

Next, 425 parts of the polyester 1 and 230 parts of ethyl acetate were added to the material solution 1 and the mixture was stirred by the beads mill for one pass under the same conditions to prepare a pigment and wax dispersion liquid 1. The pigment and wax dispersion liquid 1 had a solid content concentration of 50%.

<Preparation of Aqueous Phase>

970 parts of ion-exchanged water, 40 parts of an aqueous dispersion including an organic particulate resin a copolymer of styrene-methacrylic acid-butylacrylate-sodium salt of sulfate of ethylene oxide adduct of methacrylic acid in an mount of 25% by weight, 140 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous Liquid, i.e., an aqueous phase 1.

<Emulsification>

975 parts of the pigment and wax dispersion liquid 1 and 2.6 parts of isophoronediamine were mixed in a vessel by a TK-type homomixer from Tokushu Kika Kogyo Co., Ltd. at 5,000 rpm for 1 min. Then, 88 parts of the prepolymer 1 were added to the mixture and mixed therewith by the TK-type homomixer at 5,000 rpm for 1 min. Then, 1,200 parts of the aqueous phase 1 were added to the mixture and mixed by the TK-type homomixer at from 8,000 to 13,000 rpm for 20 min to prepare an emulsified slurry 1.

<De-Solvent>

The emulsified slurry 1 was put in a vessel including a stirrer and a thermometer, a solvent was removed therefrom at 30° C. for 8 hrs to prepare a dispersion slurry 1.

(Washing ⇒ Drying)

(1) After the dispersion slurry 1 was filtered under reduced pressure to prepare a filtered cake, 100 parts of ion-exchanged water were added to the filtered cake and mixed by the TK-type homomixer at 12,000 rpm for 10 min, and the mixture was filtered. The filtrate was lacteous.

(2) Further, 900 parts of ion-exchanged water were added to the filtered cake and mixed by the TK-type homomixer at 12,000 rpm for 30 min upon application of ultrasonic vibration, and the mixture was filtered under reduced pressure. This ultrasonic alkaline washing was repeated until the slurry has a conductivity not greater than 10 μC/cm.

(3) Further, hydrochloric acid having a concentration of 10% was added to the filtered cake and mixed by the TK-type homomixer at 12,000 rpm for 30 min until the slurry has a pH of 4.

(4) Further, 100 parts of ion-exchange water were added to the filtered cake and mixed by the TK-type homomixer at 12,000 rpm for 10 min, and the mixture was filtered. This operation was repeated until the slurry has a conductivity not greater than 10 μC/cm to prepare a filtered cake 1.

The filtered cake 1 was dried by an air drier at 45° C. for 48 hrs and sieved by a mesh having an opening of 75 μm to prepare a parent toner 1.

The parent toner 1 had an average circularity of 0.972, a volume-average particle diameter (Dv) of 6.5 μm, a number-average particle diameter of 5.4 μm and Dv/Dn of 1.20. The parent toner 1 includes a paraffin wax in an mount of 4 parts by weight.

100 parts of the parent toner 1, 1.1 parts of hydrophobic small-size silica and 1.9 parts of hydrophobic medium-size silica were mixed in HENSCHEL mixer at 40 m/s to prepare a toner of the present invention.

The wax quantity at the surface of the toner 1 was measured by the ATR method. The results are shown in Table 1.

3,000 copies of a predetermined A4 print pattern having an image area of 5% were continuously produced by IPSiO CX2500 from Ricoh Company, Ltd. in the environment of 23° C. and 45% RH, wherein the contact charger was modified to use the method and have the surface resistivity shown in Table 1, to evaluate image quality thereof.

Whether (i) hollow images on a solid image and (ii) stripe images on a solid image were produced was evaluated.

○: good (no hollow and strip image)
Δ: slightly produced
x: unacceptable
xx: noticeably produced The roller contact charger in Table 1 includes a core metal; and a foamed urethane layer located overlying the core metal, including a urethane resin, electroconductive particulate carbon black, a sulfurizer, a foamer, etc. and having a medium resistivity.

The fur brush charger in Table 1 includes brush fibers formed of a carbon-dispersed 6 nylon.

The surface resistivities of the contact chargers were controlled with the content of the electroconductive particulate material.

Examples 2 to 12 and Comparative Examples 1 to 9

The content of the (paraffin) wax, the resistivity adjuster and the content thereof, the charging method and the surface resistivity were changed as shown in Table 1. The results are shown in Table 1.

TABLE 1-1

| | Low-softening Point composition | | | | |
|---|---|---|---|---|---|
| | Wax | | Resistivity adjuster | | Volume resistivity of wax + resistivity adjuster (Rvw) |
| | | Content [wt %] | | Content [wt %] | [Ω · cm] |
| Example 1 | Paraffin wax | 4 | Alkyl ester phosphate | 1.0 | $1.1 \times 10^7$ |
| Example 2 | | | Distearyl Dimethyl ammonium salt | | $2.7 \times 10^7$ |
| Example 3 | | | N-alkyl-N,N-dimethyl ammonium betaine | | $8.3 \times 10^6$ |
| Example 4 | | | | | |
| Example 5 | | | | | |
| Example 6 | | | | | |
| Example 7 | | | Aluminum fine powder | 0.5 | $2.4 \times 10^5$ |
| Example 8 | | | Titanium oxide | 0.4 | $6.6 \times 10^5$ |
| Example 9 | | | | | |
| Example 10 | | | | | |
| Example 11 | | | | | |
| Example 12 | | | Alkyl ester phosphate | 0.5 | $7.3 \times 10^6$ |
| | | | Titanium oxide | 0.2 | |
| Comparative Example 1 | Paraffin wax | 4 | None | | |
| Comparative Example 2 | | 2.5 | | | $2.8 \times 10^{14}$ (only wax) |
| Comparative Example 3 | | 5.5 | | | |
| Comparative Example 4 | | 4 | Distearyl Dimethyl ammonium salt | 0.8 | $5.2 \times 10^7$ |
| Comparative Example 5 | | 8 | N-alkyl-N,N-dimethyl ammonium betaine | 2.0 | $9.5 \times 10^6$ |
| Comparative Example 6 | | | | | |
| Comparative Example 7 | | | | | |
| Comparative Example 8 | | | | | |
| Comparative Example 9 | | | Aluminum fine powder | 1.0 | $4.1 \times 10^5$ |

TABLE 1-2

| | Contact Charger | | Properties | | Image Quality | |
|---|---|---|---|---|---|---|
| | Method | Surface resistivity (Rse) [Ω] | Rvw/Rse | Surface wax qty. | Hollow images | Stripe images |
| Example 1 | Roller 1 | $2.5 \times 10^6$ | 4.4 | 0.08 | ○ | ○ |
| Example 2 | | | 10.8 | 0.09 | ○ | ○ |
| Example 3 | | | 3.32 | 0.07 | ○ | ○ |
| Example 4 | Roller 2 | $9.1 \times 10^5$ | 9.12 | | ○ | ○ |
| Example 5 | Roller 3 | $7.4 \times 10^5$ | 11.2 | | ○ | ○ |
| Example 6 | Brush | $4.9 \times 10^6$ | 1.69 | | ○ | ○ |
| Example 7 | Roller 1 | $2.5 \times 10^6$ | 0.10 | 0.11 | ○ | ○ |
| Example 8 | | | 0.26 | 0.10 | ○ | ○ |
| Example 9 | Roller 2 | $9.1 \times 10^5$ | 0.73 | | ○ | ○ |
| Example 10 | Roller 3 | $7.4 \times 10^5$ | 0.89 | | ○ | ○ |
| Example 11 | Brush | $4.9 \times 10^6$ | 0.14 | | ○ | ○ |
| Example 12 | Roller 1 | $2.5 \times 10^6$ | 2.92 | 0.09 | ○ | ○ |
| Comparative Example 1 | Roller 1 | $2.5 \times 10^6$ | $1.12 \times 10^8$ | 0.08 | X | ○ |
| Comparative Example 2 | | | | 0.05 | Δ | ○ |
| Comparative Example 3 | | | | 0.17 | X X | ○ |
| Comparative Example 4 | | | 20.8 | 0.10 | Δ | ○ |
| Comparative Example 5 | | | 3.80 | 0.25 | ○ | X |
| Comparative Example 6 | Roller 2 | $9.1 \times 10^5$ | 10.4 | | ○ | X |
| Comparative Example 7 | Roller 3 | $7.4 \times 10^5$ | 12.8 | | ○ | X |
| Comparative Example 8 | Brush | $4.9 \times 10^6$ | 1.94 | | ○ | X |
| Comparative Example 9 | Roller 1 | $2.5 \times 10^6$ | 0.16 | 0.29 | ○ | X X |

This application claims priority and contains subject matter related to Japanese Patent Application No. 2006-243210 filed on Sep. 7, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

The invention claimed is:

1. An image forming apparatus, comprising:

a photoreceptor;

a charger having a surface resistivity, configured to charge the photoreceptor with a charger contacting thereto;

an irradiator configured to irradiate the photoreceptor to form an electrostatic latent image thereon;

an image developer containing a toner, which is configured to develop the electrostatic latent image with the toner to form a toner image on the photoreceptor;

a transferer configured to transfer the toner image onto a recording material directly or through an intermediate transferer; and a fixer configured to fix the toner image on the recording material, wherein the toner of the image developer comprises:

a binder resin;

a colorant;

a composition having a low softening point; and an external additive, and wherein the surface resistivity Rse[Ω] of the charger and a volume resistivity Rsw [Ω·cm] of the composition having a low softening point satisfy the following relationship:

$$0.8\times10^{-1}Rse<Rvw<1.5\times10Rse.$$

2. The image forming apparatus of claim 1, wherein the composition having a low softening point comprises a hydrocarbon wax.

3. The image forming apparatus of claim 2, wherein the composition having a low softening point further comprises a resistivity adjuster.

4. The image forming apparatus of claim 3, wherein the resistivity adjuster comprises an ionic surfactant.

5. The image forming apparatus of claim 3, wherein the resistivity adjuster comprises an electroconductive particulate material.

6. The image forming apparatus of claim 3, wherein the resistivity adjuster comprises an ionic surfactant and an electroconductive particulate material.

7. The image forming apparatus of claim 2, wherein an amount of wax in the toner is from 2 to 6% by weight of the toner.

8. The image forming apparatus of claim 1, wherein the binder resin comprises a resin having a polyester skeleton comprising an aromatic molecular chain.

9. The image forming apparatus of claim 2, wherein a relative ratio P of a peak specific to the wax (2,850 $cm^{-1}$) to a peak specific to the resin (828 $cm^{-1}$), which is a surface wax quantity present within the depth of 0.3 μm from the surface of the toner, is from 0.02 to 0.2 when measured by ATR method.

10. The image forming apparatus of claim 1, wherein the contact charger is one selected from the group consisting of a roller charger, a fur brush charger, a magnetic brush charger and a blade charger.

11. The image forming apparatus of claim 10, wherein the contact charger is a roller charger.

12. The image forming apparatus of claim 10, wherein the contact charger is a fur brush charger.

13. The image forming apparatus of claim 1, wherein a surface resistivity, Rse, of the contact charger is from $1\times10^3$ to $1\times10^8$[Ω] in accordance with JIS K 6911 when applied with DC 1000 V in an environment of 23° C. and 45% RH.

* * * * *